United States Patent [19]

Eads et al.

[11] 4,436,267

[45] Mar. 13, 1984

[54] HOSE HANGER

[75] Inventors: Harold O. Eads, Parkersburg, W. Va.; Ronald R. Fowler, Coolville, Ohio

[73] Assignee: O. Ames Co., Parkersburg, W. Va.

[21] Appl. No.: 363,374

[22] Filed: Mar. 29, 1982

[51] Int. Cl.[3] ..... A62C 23/04; B05B 15/06

[52] U.S. Cl. ..... 248/75; 248/79; 248/89

[58] Field of Search ..... 248/75, 77, 78, 76, 248/79, 80, 89, 90

[56] References Cited

U.S. PATENT DOCUMENTS

| | | | |
|---|---|---|---|
| 2,453,248 | 11/1948 | Much | 248/75 |
| 2,859,007 | 11/1958 | Cooke | 248/75 |
| 3,029,933 | 4/1962 | Sutter | 206/46 |
| 3,266,763 | 8/1966 | Kutz | 248/89 |
| 4,253,716 | 3/1981 | Turner, Jr. | 248/79 |

FOREIGN PATENT DOCUMENTS

| | | | |
|---|---|---|---|
| 510671 | 6/1957 | Italy | 248/89 |

*Primary Examiner*—Ramon S. Britts
*Assistant Examiner*—Ramon O. Ramirez

[57] ABSTRACT

A hanger adapted to be fixedly attached to a mounting wall for supporting a length of hose in coiled formation of the type which comprises a one-piece body molded of plastic material so as to provide an upright mounting wall engaging section adapted to be fixedly attached to a mounting wall, a hose coil supporting section extending horizontally from the bottom of the mounting wall engaging section and a hose coil retaining section extending upwardly from the horizontally outwardly extending end of said hose coil supporting section. The hanger embodies improvements which include forming the coil supporting section with (1) spaced thin wall saddle portions defining hose coil engaging surfaces facing generally upwardly and disposed generally in an arcuate plane, and (2) horizontal thin wall channel structures integrally interconnected between the spaced thin wall saddle portions disposed below the adjacent hose coil engaging surfaces thereof and opening generally in a direction toward the same.

12 Claims, 4 Drawing Figures

Fig. 1
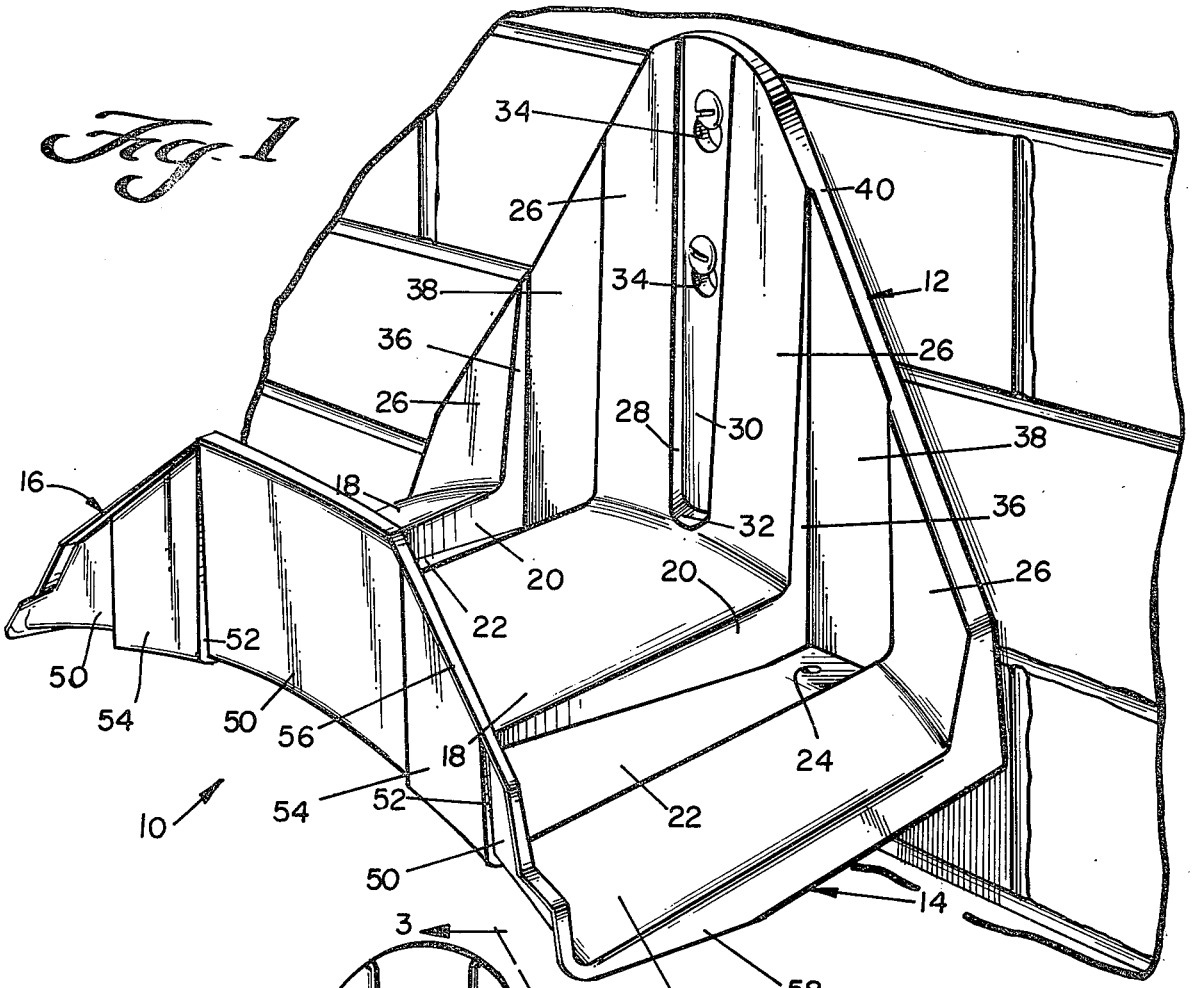
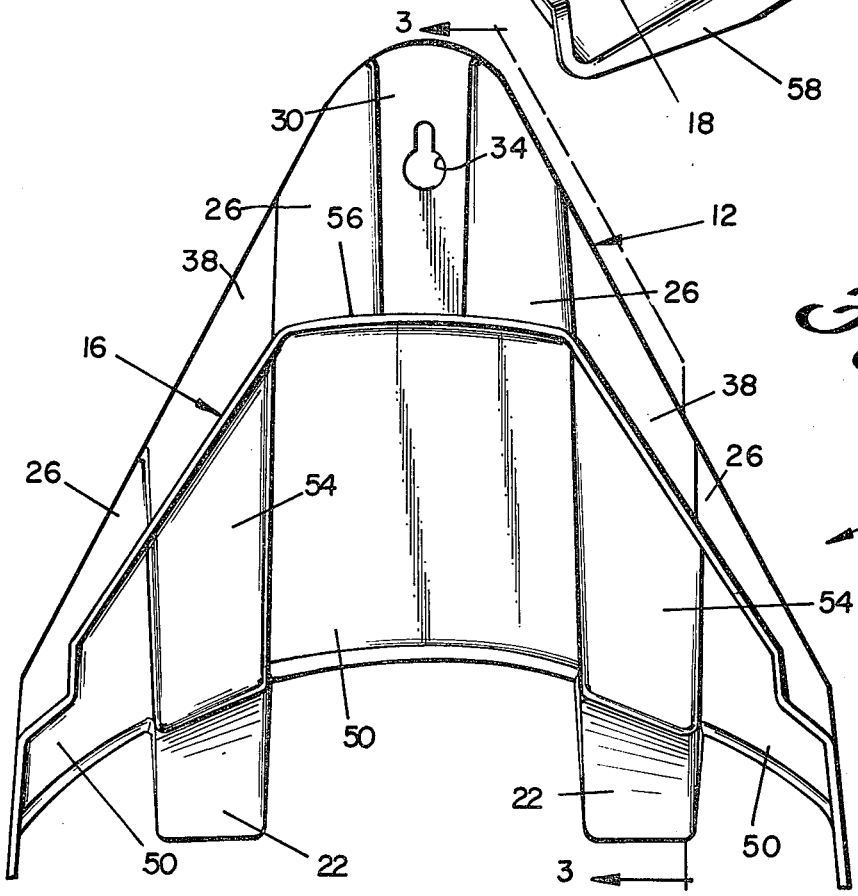
Fig. 2

HOSE HANGER

This invention relates to hose hangers and more particularly to hose hangers of the type which are adapted to be fixedly secured to a mounting wall so as to support a length of hose in coiled formation.

Hangers of the type herein contemplated have been commercially available for many years. Typically, hangers of this type are fabricated of metal. An exemplary embodiment of a metal fabrication is disclosed in U.S. Pat. No. 3,029,933, dated Apr. 17, 1962.

An effort has been made over the years to fabricate a hanger of this type of plastic material. Basically, the all-plastic hanger which has been heretofore proposed and made available commercially has closely followed the construction embodied in the all-metal hangers with the various sections of the hanger being formed of plastic ribbed web construction. For example, in lieu of the arcuate shaped hose coil supporting section formed of sheet metal in U.S. Pat. No. 3,029,933, the all-plastic hanger provides a plastic web providing a continuous arcuate upper surface with divider ribs or ridges thereof similar to the construction shown in the patent and peripheral and interior reinforcing ribs extending downwardly from the lower arcuate surface of the web. The all-plastic hanger includes an upstanding mounting wall engaging section integrally connected with the central portion of the rear face of the arcuate section. The upstanding mounting wall engaging section has a width approximately one-half the width of the arcuate section at the position of attachment thereto. The width of the mounting wall section diminishes or tapers in a converging upward manner. Here again the construction of the mounting wall engaging section is such as to provide a planar web which forms a continuation of the central portion of the rib at the rear of the arcuate section, the web having peripheral ribs or flanges between the position of attachment, a single interior vertical rib and a pair of interconnected horizontal ribs. The horizontal ribs interconnect at their inner ends with peripheral ribs defining fastener receiving openings. The openings are adapted to receive screws which serve to fixedly attach the mounting wall engaging section to the mounting wall. The all-plastic hanger of the prior art is formed with a hose coil retaining section which is in the form of a pair of spaced upright ribbed web structures of a configuration similar to the mounting wall engaging section except that each is of a smaller size and does not include the openings and the peripheral or horizontal ribs associated therewith.

While the all-plastic hose hanger of the prior art described above has received a measure of acceptance, there is a need for an all-plastic hanger which more efficiently employs the plastic material utilized so as to enable a hanger of equal strength to be made of less material or, alternatively, a hanger of the same amount of plastic material stronger. It is an object of the present invention to fulfill such a need. In accordance with the principles of the present invention this objective is obtained by embodying the following improvements in an all-plastic hanger of the type previously described. Rather than to provide the traditional ribbed web construction, the hose coil supporting section is constructed to provide spaced thin wall saddle portions defining hose coil engaging surfaces facing generally upwardly and disposed generally in an arcuate plane and thin wall channel means integrally interconnected between the spaced thin wall saddle portions disposed below the adjacent hose coil engaging surfaces thereof and opening generally in a direction toward the same. The mounting wall engaging section is constructed to provide spaced thin wall side portions defining hose coil retaining surfaces disposed in upwardly extending relation with respect to associated hose coil engaging surfaces of the saddle portions and facing generally in a direction thereabove and thin wall channel means integrally interconnected between the spaced thin wall side portions disposed horizontally outwardly from the adjacent hose coil retaining surfaces thereof and opening generally in a direction toward the same. The thin wall channel means in the mounting wall engaging section is integrally connected with the thin wall channel means in the hose coil supporting section and provides mounting wall engaging surface means adjacent the integral connection thereof with the thin wall channel means in the hose coil supporting section.

Preferably, the hanger of the present invention also embodies the improvement of providing in the hose coil retaining section spaced second thin wall side portions defining second hose coil retaining surfaces disposed in upwardly extending relation with respect to associated hose coil engaging surfaces of the saddle portions and facing generally in a direction thereabove and second vertically elongated thin wall channel means integrally interconnected between the second thin wall channel means integrally interconnected between the second thin wall side portions disposed horizontally outwardly from the adjacent second hose coil retaining surfaces thereof and opening generally in a direction toward the same, the thin wall channel means of the hose coil retaining section being also integrally connected with the thin wall channel means in the hose coil supporting section.

It can be seen that thin wall channel structures integrally within the sections provides greater strength with less material as compared with the ribbed web construction of the prior art. The provision of mounting wall engaging surfaces on the channel structures of the mounting wall engaging section at positions adjacent the integral connections thereof with the channel structures in the hose coil supporting section is particularly advantageous in that such surfaces provide a compound lever transmittal of the hose weight load imposed upon the hose coil supporting section as distinguished from a simple cantilevered force transmittal, as with the prior art arrangement.

Another object of the present invention is the provision of a hose hanger of the type described which is simple in construction, effective in operation and economical to manufacture.

These and other objects of the present invention will become more apparent during the course of the following description and appended claims.

The invention may best be understood with reference to the accompanying drawings, wherein an illustrative embodiment is shown.

In the drawings:

FIG. 1 is a perspective view of a hose hanger embodying the principles of the present invention showing the same fixedly attached to a brick mounting wall;

FIG. 2 is a front elevational view of the hanger shown in FIG. 1;

Referring now more particularly to the drawings, there is shown therein a hose hanger, generally indicated at 10, which embodies the principles of the present invention. The hanger is similar to the prior art hanger previously described in that it consists of a one-piece body molded of plastic material. Any appropriate plastic material may be utilized, a preferred embodiment is polypropylene. The hanger 10 is also similar to the aforesaid prior art in that the plastic one-piece body provides three integrally interconnected sections: (1) an upright mounting wall engaging section, generally indicated at 12, which is adapted to be fixedly attached to a mounting wall; (2) a hose coil supporting section, generally indicated at 14, which extends horizontally from the bottom of the mounting wall engaging section 12; and (3) a hose coil retaining section, generally indicated at 16, which extends upwardly from the horizontally outwardly extending end of the hose coil supporting section 14.

Figure 3:
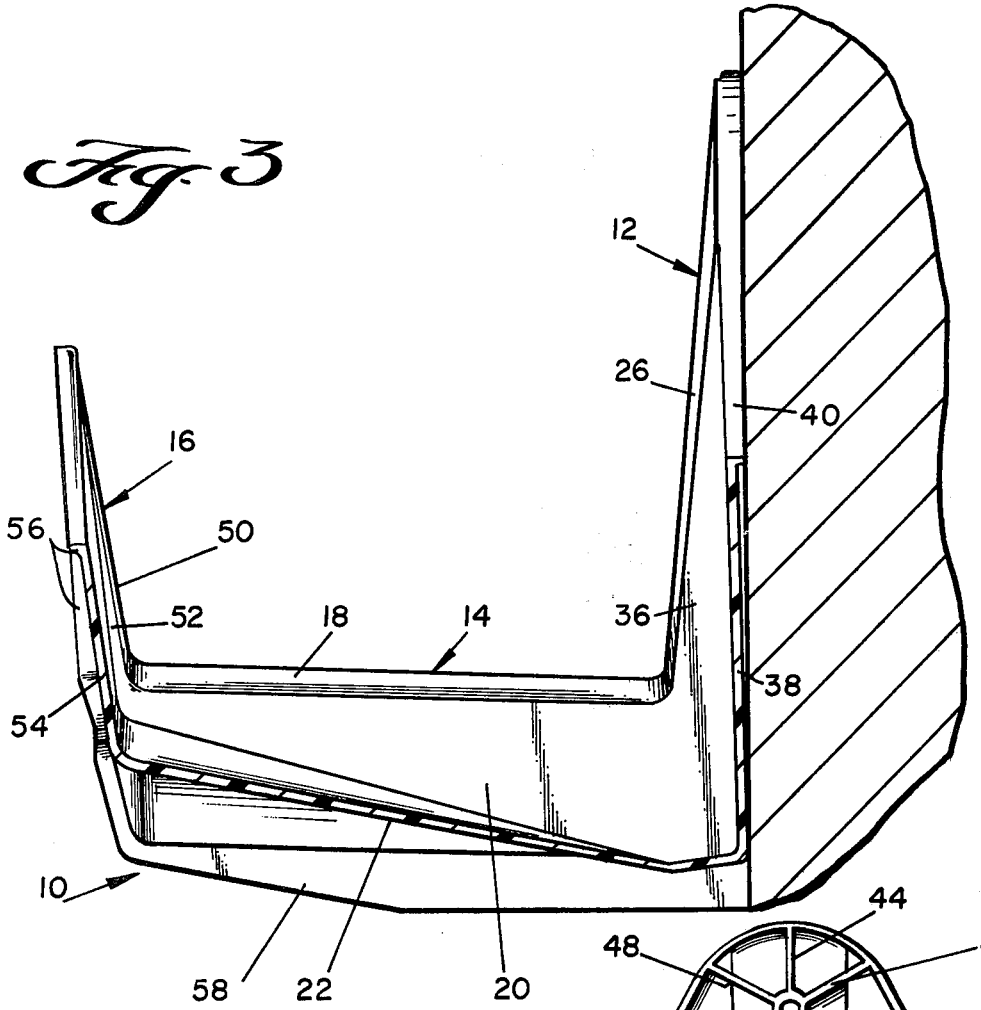
FIG. 3 is a sectional view taken along the line 3—3 of FIG. 2.

As best shown in FIGS. 1 and 3, the hose coil supporting section 14 includes in accordance with the principles of the present invention three spaced thin wall saddle portions 18. The saddle portions 18 provide generally upwardly facing hose coil engaging surfaces which are disposed generally in an arcuate plane whose axis extends generally horizontally. As shown, the central saddle portion has an arcuate extent which is approximately twice the arcuate extent of the two saddle portions on opposite sides thereof. The spaced saddle portions 18 are integrally interconnected by a pair of channel structures, each of which is of generally U-shaped cross-sectional configuration and includes spaced horizontally elongated leg walls 20 integrally interconnected with the associated saddle portions 18 and converging slightly downwardly therefrom and a horizontally elongated bight wall 22 integrally interconnected between the lower edges of the converging leg walls 20. It will be noted that each leg wall 20 has a vertical dimension which progressively decreases in a direction extending horizontally away from the mounting wall engaging section 12 and toward the hose coil retaining section 16. Moreover, the rate of depth decrease with respect to each pair of leg walls 20 varies so that the associated bight wall 22 extends horizontally therebetween at a position adjacent the mounting wall engaging section 12 and at an angle at a position adjacent the hose coil retaining section 16. Preferably a drain hole 24 extends through each bight wall 22 at its lowermost position adjacent the mounting wall engaging section 12.

The mounting wall engaging section 12 is molded to provide four spaced apart thin wall side portions 26. The two central side portions are integrally interconnected by a central channel structure of generally U-shaped cross-sectional configuration which includes two vertically elongated leg walls 28 extending horizontally outwardly from the adjacent edges of the aforesaid pair of central side portions 26 and a bight wall 30 integrally interconnected between the horizontally outward edges of the leg walls 28. Leg walls 28 are tapered and converge upwardly. The lower end of the central channel structure is closed by an end wall 32 which generally merges into the central saddle portion 18. Formed in the central bight wall 30 in vertically spaced relation near the upper end thereof is a pair of keyhole shaped screw receiving openings 34.

Integrally interconnecting each outer side wall portion 26 and the adjacent inner side wall portion 26 is a vertically elongated channel structure of generally U-shaped cross-sectional configuration formed by a pair of vertically elongated leg walls 36 extending horizontally outwardly from the associated thin wall side portions 26 and merging into the associated converging leg walls 20 of the associated horizontally extending channel structure of the hose coil supporting section 14. The horizontally outward edges of each pair of leg walls 36 is integrally interconnected with a vertically elongated bight wall 38, the lower end of which is integrally interconnected with the adjacent end of the associated bight wall 22 of the hose coil supporting section 14. As can best be seen from FIG. 3, the lower ends of the bight walls 38 provide mounting wall engaging surfaces at a position adjacent their integral interconnection with the associated bight wall 22. Leg walls 36 are tapered and converge upwardly.

It will be noted that the width of the mounting wall engaging section 12 at its position of interconnection with the hose coil supporting section 14 is essentially the same as the width of the latter. It will also be noted that at a position above the position of juncture, the width of the mounting wall engaging section 12 diminishes upwardly to a minimum at the upper edge end thereof. A peripheral flange 40 extends horizontally outwardly along the peripheral edge of the mounting wall engaging section between the juncture thereof with the hose coil supporting section 14.

Figure 4:
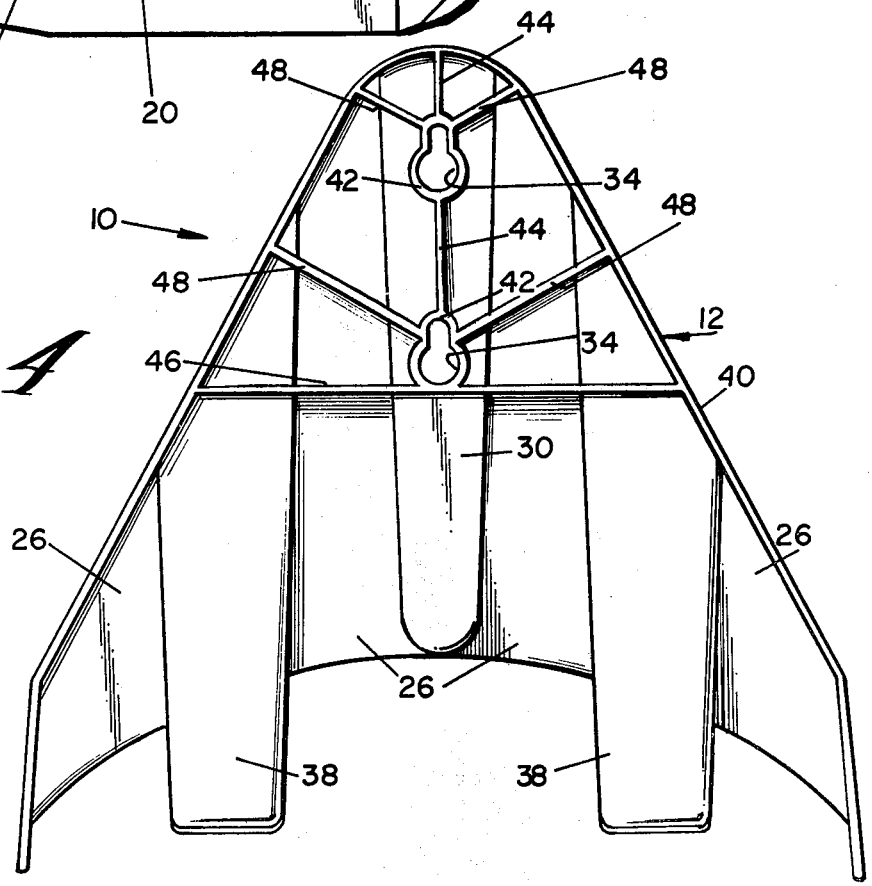
FIG. 4 is a rear elevational view of the hanger.

As best shown in FIG. 4, in the area of the mounting wall engaging section 12 adjacent the openings 34 there is formed a series of internal strengthening ribs which include peripheral keyhole ribs 42, central vertical ribs 44, a lower horizontal rib 46 and pairs of diagonal ribs 48. As can be clearly seen from FIG. 4, the horizontally outwardly facing end surfaces of the ribs are disposed in a common plane with the horizontally outwardly disposed end surfaces of the peripheral flange 40. The internal ribs provide strength at the position where the mounting wall engaging section 12 is fixedly attached to the mounting wall with the lower portions of the flanges 40 and the lower mounting wall engaging surfaces of the bight walls 38 providing a desirable engagement with the mounting wall at a position below the position of integral interconnection between the mounting wall engaging section 12 and the hose coil supporting section 14.

The hose coil retaining section 16 is formed to provide three thin wall side portions 50 which define hose coil retaining surfaces disposed in upwardly extending relation with respect to the three hose coil engaging surfaces of the saddle portions 18 and facing generally in a direction thereabove. Integrally interconnected between the three side wall portions 50 is a pair of vertically elongated channel structures, each of which is of generally U-shaped cross-sectional configuration and includes a pair of vertically elongated leg walls 52 extending horizontally outwardly from the associated thin wall side portions 50 and merging into the associated converging leg walls 20 of the associated channel structure of the hose coil supporting section 14. Each of the channel structures in the hose coil retaining section 16 also includes a vertically elongated bight wall 54 which is integrally interconnected between the horizontally outer edges of the associated leg walls 52, the lower end of each bight wall 54 is integrally interconnected with the adjacent end of the associated bight wall 22. It will be noted that the bight walls 54 extend upwardly in angular relationship with respect to a vertical plane.

The bight walls 38 extend angularly in a similar direction, however the angle of inclination of the bight walls 38 is less than the angle of inclination of the wall 54.

The width of the hose coil retaining section 16 at the position of interconnection therewith with the hose coil supporting section 14 is generally equal to the width of the latter. Here again, above the position of interconnection the width of the hose coil retaining section diminishes upwardly to a minimum at its upper end. Also as before, flange 56 extends horizontally outwardly along the periphery of the hose coil retaining section 16 between the position of attachment thereof with the hose coil supporting section 14. Finally, it will be noted that the ends of the peripheral flanges 40 and 56 on the sections 12 and 16 respectively are integrally joined by a pair of depending flanges 58 extending along the free edges of the outer saddle portions 18 of the hose coil supporting section 14.

It can thus be seen that there is provided a hose hanger constituting a one-piece plastic body which maximizes strength while minimizing the amount of material required to provide such strength. This result is achieved primarily by the provision of the integrally interconnected channel structures which are formed in the mounting wall engaging section 12 and the hose coil supporting section 14. The carrying forward of integrally interconnected channel structures in the hose coil retaining section 16 provides strength in this section where it is desired while at the same time enabling a desired amount of flexure to occur.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a hanger adapted to be fixedly attached to a mounting wall for supporting a length of hose in coiled formation which comprises a one-piece body molded of plastic material, said body including an upright mounting wall engaging section adapted to be fixedly attached to a mounting wall, a hose coil supporting section extending horizontally from the bottom of said mounting wall engaging section and a hose coil retaining section extending upwardly from the horizontally outwardly extending end of said hose coil supporting section, the improvement which comprises:

said hose coil supporting section including spaced thin wall saddle portions defining hose coil engaging surfaces facing generally upwardly and disposed generally in an arcuate plane and thin wall channel means integrally interconnected between said spaced thin wall saddle portions disposed below the adjacent hose coil engaging surfaces thereof and opening generally in a direction toward the same, said mounting wall engaging section including spaced thin wall side portions defining hose coil retaining surfaces disposed in upwardly extending relation with respect to associated hose coil engaging surfaces of said saddle portions and facing generally in a direction thereabove and thin wall channel means integrally interconnected between said spaced thin wall side portions disposed horizontally outwardly from the adjacent hose coil retaining surfaces thereof and opening generally in a direction toward the same, the thin wall channel means in said mounting wall engaging section being integrally connected with the thin wall channel means in said hose coil supporting section and providing mounting wall engaging surface means adjacent the integral connection thereof with the thin wall channel means in said hose coil supporting section.

2. A hanger as defined in claim 1 wherein said thin wall channel means in said hose coil supporting section includes a pair of generally horizontally extending channel structures spaced centrally therein and said thin wall channel means in said mounting wall engaging section includes a pair of generally vertically extending channel structures spaced apart a distance equal to the spacing of horizontally extending channel structures.

3. A hanger as defined in claim 2 wherein each horizontally extending channel structure is generally U-shaped in cross-sectional configuration and includes spaced horizontally elongated leg walls integrally connected with the associated saddle portions and converging slightly downwardly therefrom and a bight wall integrally interconnected between the lower edges of said converging leg walls, each vertically extending channel structure being generally U-shaped in cross-sectional configuration and including spaced vertically elongated leg walls extending outwardly from the associated thin wall side portions and merging into the associated converging leg walls of the associated horizontally extending channel structure and an upright bight wall integrally interconnected between the outer edges of the vertically elongated leg walls and joined in end-to-end relation to the bight wall of the associated horizontally extending channel structure.

4. A hanger as defined in claim 3 wherein each leg wall of each horizontally extending channel structure has a vertical dimension which progressively decreases in a horizontal direction away from said mounting wall engaging section and toward said hose coil retaining section.

5. In a hanger adapted to be fixedly attached to a mounting wall for supporting a length of hose in coiled formation which comprises a one-piece body molded of plastic material, said body including an upright mounting wall engaging section adapted to be fixedly attached to a mounting wall, a hose coil supporting section extending horizontally from the bottom of said mounting wall engaging section and a hose coil retaining section extending upwardly from the horizontally outwardly extending end of said hose coil supporting section, the improvement which comprises:

said hose coil supporting section including spaced thin wall saddle portions defining hose coil engaging surfaces facing generally upwardly and disposed generally in an arcuate plane and horizontally elongated thin wall channel means integrally interconnected between said spaced thin wall saddle portions disposed below the adjacent hose coil engaging surfaces thereof and opening generally in a direction toward the same, said mounting wall engaging section including spaced first thin wall side portions defining first hose coil retaining surfaces disposed in upwardly extending relation with respect to associated hose coil engaging surfaces of said saddle portions and facing generally in a direction thereabove and first vertically elongated thin wall channel means integrally interconnected between said spaced first thin wall side portions disposed horizontally outwardly from the adjacent first hose coil retaining surfaces thereof and opening generally in a direction toward the same, said hose coil retaining section including spaced second thin wall side portions defining second hose coil retaining surfaces disposed in upwardly extending relation with respect to associated hose coil engaging surfaces of said saddle portions and facing generally in a direction thereabove and second vertically elongated thin wall channel means integrally interconnected between said second thin wall side portions disposed horizontally outwardly from the adjacent second hose coil retaining surfaces thereof and opening generally in a direction toward the same, said first and second vertically elongated thin wall channel means being integrally connected with the ends of said horizontally elongaged channel means respectively, the thin wall channel means in said mounting wall engaging section providing mounting wall engaging surface means adjacent the integral connection thereof with the thin wall channel means in said hose coil supporting section.

6. A hanger as defined in claim 5 wherein said horizontally elongated thin wall channel means includes a pair of generally horizontally extending channel structures spaced centrally in said hose coil supporting section and said first and second vertically elongated thin wall channel means include first and second pairs of generally vertically extending channel structures respectively, each pair of which is spaced apart a distance equal to the spacing of the pair of horizontally extending channel structures and joins one of the ends thereof.

7. A hanger as defined in claim 6 wherein each horizontally extending channel structure is generally U-shaped in cross-sectional configuration and includes spaced horizontally elongated leg walls integrally connected with the associated saddle portions and converging slightly downwardly therefrom and a bight wall integrally interconnected between the lower edges of said converging leg walls, each vertically extending channel structure being generally U-shaped in cross-sectional configuration and including spaced vertically elongated leg walls extending outwardly from the associated thin wall side portions and merging into the associated converging leg walls of the associated horizontally extending channel structure and an upright bight wall integrally interconnected between the outer edges of the vertically elongated leg walls and joined in end-to-end relation with the bight wall of the associated horizontally extending channel structure.

8. A hanger as defined in claim 7 wherein each leg wall of each horizontally extending channel structure has a vertical dimension which progressively decreases in a horizontal direction away from said mounting wall engaging section and toward said hose coil retaining section.

9. A hanger as defined in claim 3, 4, 7 or 8 wherein each leg wall of each vertically extending channel structure has a horizontal dimension which decreases in a direction upwardly from its position of merger with the associated leg wall of the associated horizontally extending channel structure.

10. A hanger as defined in claim 2, 3, 4, 5, 6, 7 or 8 wherein the width of said mounting wall engaging section is generally equal to the width of said hose coil supporting section at the position of attachment therebetween, the width of said mounting wall engaging section diminishing above the aforesaid position of attachment to a minimum width at its upper end.

11. A hanger as defined in claim 2, 3, 4, 5, 6, 7 or 8 wherein the width of said hose coil retaining section is generally equal to the width of said hose coil supporting section at the position of attachment therebetween, the width of said mounting wall engaging section diminishing above the aforesaid position of attachment to a minimum width at its upper end.

12. A hanger as defined in claim 10 wherein said mounting wall engaging section and said hose coil retaining section each includes a continuous flange extending horizontally outwardly along the periphery thereof between the position of attachment with said hose coil supporting section.

* * * * *